US008857396B2

(12) United States Patent
Giffels et al.

(10) Patent No.: US 8,857,396 B2
(45) Date of Patent: Oct. 14, 2014

(54) IGNITER FOR IGNITING A FUEL-AIR-MIXTURE USING HF CORONA DISCHARGE AND ENGINE FITTED WITH SUCH IGNITERS

(75) Inventors: Thomas Giffels, Stuttgart (DE); Timo Stifel, Korntal-Münchingen (DE); Steffen Bohne, Freiberg (DE); Helmut Müller, Hessingheim (DE)

(73) Assignee: Borgwarner Beru Systems GmbH (DE)

( * ) Notice: Subject to any disclaimer, the term of this patent is extended or adjusted under 35 U.S.C. 154(b) by 688 days.

(21) Appl. No.: 13/197,959

(22) Filed: Aug. 4, 2011

(65) Prior Publication Data

US 2012/0055434 A1 Mar. 8, 2012

(51) Int. Cl.

| | |
|---|---|
| ***H01T 13/20*** | (2006.01) |
| ***H01T 13/54*** | (2006.01) |
| ***F02P 15/08*** | (2006.01) |
| ***H01T 13/50*** | (2006.01) |
| *F02P 15/04* | (2006.01) |
| *F02P 13/00* | (2006.01) |
| *F02P 3/01* | (2006.01) |

(52) U.S. Cl.

CPC ..... *H01T 13/50* (2013.01); *F02P 15/04* (2013.01); *F02P 15/08* (2013.01); *F02P 13/00* (2013.01); *F02P 3/01* (2013.01)

USPC ..... 123/169 R; 313/141

(58) Field of Classification Search

USPC .... 123/143 B, 169 EL, 169 MG, 169 R, 536, 123/606, 608; 313/136–142

See application file for complete search history.

(56) References Cited

U.S. PATENT DOCUMENTS

| | | | | |
|---|---|---|---|---|
| 5,554,908 | A * | 9/1996 | Kuhnert et al. | 313/140 |
| 6,608,430 | B1 * | 8/2003 | Schaus | 313/140 |
| 7,798,118 | B2 * | 9/2010 | Gagliano et al. | 123/266 |
| 8,104,444 | B2 * | 1/2012 | Schultz | 123/143 B |
| 8,217,560 | B2 * | 7/2012 | Giffels et al. | 313/136 |
| 8,324,792 | B2 * | 12/2012 | Maul et al. | 313/141 |

(Continued)

FOREIGN PATENT DOCUMENTS

| | | | |
|---|---|---|---|
| DE | 197 47 700 | A1 | 12/1999 |
| JP | 57-186066 | A1 | 11/1982 |
| WO | WO 00/01047 | A1 | 1/2000 |
| WO | WO 2004/063560 | A1 | 7/2004 |

*Primary Examiner* — Thomas Moulis
*Assistant Examiner* — Elizabeth Hadley
(74) *Attorney, Agent, or Firm* — Keith H. Orum; Orum & Roth, LLC

(57) ABSTRACT

An igniter for igniting a fuel-air-mixture in a combustion chamber, in particular in a combustion engine with one or several combustion chambers, by generating a high frequency corona discharge, said ignitiger comprising an assembly comprising an ignition electrode, an outer conductor surrounding the ignition electrode, which has a front end and a rear end, and an electrical insulator arranged between the ignition electrode and the outer conductor, wherein the ignition electrode is part of an electrical high-frequency resonant circuit, protrudes over the front end of the outer conductor, and is connected to an alternate current source or alternate voltage source which feeds the HF-resonant circuit, and delivers a high frequency alternate current or a high frequency alternate voltage, respectively. The ignition electrode is branched into more than four electrode branches extending away from the outer conductor, in different directions.

22 Claims, 6 Drawing Sheets

(56) References Cited

U.S. PATENT DOCUMENTS

Figure 3:
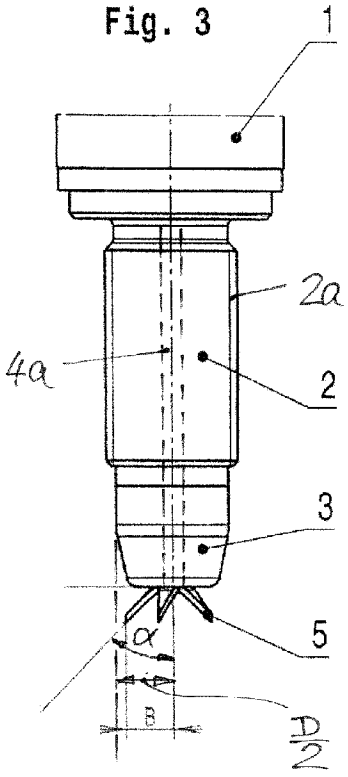

| | | | | |
|---|---|---|---|---|
| 8,434,443 | B2 * | 5/2013 | Lykowski et al. | 123/169 R |
| 8,536,769 | B2 * | 9/2013 | Kuhnert et al. | 313/140 |
| 2002/0033156 | A1 * | 3/2002 | Jayne | 123/169 EL |
| 2009/0107437 | A1 | 4/2009 | Schultz | |
| 2010/0083942 | A1 | 4/2010 | Lykowski et al. | |
| 2010/0212631 | A1 * | 8/2010 | Makarov et al. | 123/406.19 |
| 2012/0180743 | A1 * | 7/2012 | Burrows et al. | 123/169 R |
| 2013/0049566 | A1 * | 2/2013 | Burrows et al. | 313/141 |
| 2014/0116369 | A1 * | 5/2014 | Stifel et al. | 123/143 B |
| 2014/0116370 | A1 * | 5/2014 | Stifel et al. | 123/143 B |
| 2014/0137845 | A1 * | 5/2014 | Achtstatter et al. | 123/634 |

* cited by examiner 2
2a
3
4a
5
5a
6
4b
α

IGNITER FOR IGNITING A FUEL-AIR-MIXTURE USING HF CORONA DISCHARGE AND ENGINE FITTED WITH SUCH IGNITERS

The invention relates to an igniter according to the features specified in the preamble of claim 1. Such an igniter is disclosed in WO 2004/063560 A1.

WO 2004/063560 A1 discloses how a fuel-air-mixture can be ignited in a combustion chamber of a combustion engine by means of a corona discharge generated in the combustion chamber. For this purpose, an ignition electrode extends electrically insulated through one of the walls of the combustion chamber, which is at earth potential, and reaches into the combustion chamber, preferably opposite to a piston provided in the combustion chamber. The ignition electrode forms a capacitance together with the walls of the combustion chamber at earth potential as a counter electrode. The insulator which surrounds the ignition electrode, and the combustion space with its content act as a dielectric. Depending on the cycle of the piston the combustion chamber contains air or a fuel-air-mixture or an exhaust gas.

The capacitance is an integral part of an electrical resonant circuit, which is energized with a high frequency voltage, which for instance is generated by means of a transformer with centre tap. The transformer interacts with a switching device, which applies a predefinable D.C. voltage alternately to both primary windings of the transformer connected by the centre tap. The secondary winding of the transformer feeds a series resonant circuit, in which the capacitance formed by the ignition electrode and the walls of the combustion chamber is situated. The frequency of the alternate voltage energizing the resonant circuit is controlled in such a way that it is as close as possible to the resonance frequency of the resonant circuit. The result is a voltage overshoot between the ignition electrode and the walls of the combustion chamber, in which the ignition electrode is arranged. The resonance frequency ranges typically between 30 kHz and 3 MHz and the alternate voltage reaches values of for instance 50 kV to 500 kV at the ignition electrode.

In this way, a high frequency corona discharge can be generated in the combustion chamber. On the one hand, the corona discharge should not turn into an arc discharge or a spark discharge. It is therefore ensured that the voltage between the ignition electrode and the combustion chamber at earth potential remains below the voltage causing a complete breakthrough. On the other hand, the corona discharge, which occurs in the environment of the end of the ignition electrode protruding into the combustion chamber, should release the greatest possible electric charge, to create favorable conditions for igniting the fuel-air-mixture. Prior art therefore strives to generate the high-frequency corona discharge at a voltage as little as possible below the breakthrough voltage.

An object of the present invention is then to provide an igniter of the type above mentioned, with which better ignition conditions than according to the state of the art can be achieved.

This object is met by an igniter having the features specified in claim 1. Advantageous refinements of the invention are described in the sub-claims. Claim 22 refers to an engine fitted with igniters according to the invention.

The igniter according to the invention for igniting a fuel-air-mixture by generating a high-frequency corona discharge in a combustion chamber, in particular in a combustion engine with one or several combustion chambers, contains an assembly comprising an ignition electrode, an outer conductor which surrounds the ignition electrode and has a front end and a rear end, and an electrical insulator arranged between the ignition electrode and the outer conductor. The ignition electrode and the outer conductor are connected to one another via the insulator. The ignition electrode is part of an electrical high frequency resonant circuit and therefore connected to an alternate current source or alternate voltage source feeding the HF-resonant circuit and delivering a high frequency alternate current or a high frequency alternate voltage, respectively. An end of the ignition electrode—designated below as its front end—protrudes over the front end of the outer conductor. The front end of the ignition electrode is branched into more than four electrode branches pointing away from the outer conductor. The electrode branches extend into different directions. Any two electrode branches are farthest apart from each other at their pointed ends. The solid angles between the directions to which any two neighboring electrode branches point with their pointed ends are so large that charge carrier clouds caused by the HF-corona discharges and arising from the electrode branches overlap at most in their edge regions.

Preferably it is intended that the overlapping of neighboring charge carrier clouds does not affect more than 10% of the electric charges present in a charge carrier cloud.

The invention has significant advantages:

- Several charge carrier clouds are generated simultaneously, which fill a substantially larger volume of space than prior art and thereby substantially improve the ignition of the fuel-air-mixture.
- As the tips of the electrode branches are arranged and oriented in such a way that the charge carrier clouds overlap at most in their edge regions, they do not weaken each other, but rather enable optimal ignition and far-reaching, low-pollutant combustion of the fuel.
- The invention allows for the ignition of extremely lean fuel-air-mixture and hence engines with very economical fuel consumption.

The ends of the electrode branches are more suitably arranged in regular angular distances around the longitudinal axis of the center electrode. This enables the corona discharges, taken together, to occupy the largest possible space in the combustion chamber.

The center electrode and the outer conductor have more suitably a common longitudinal median line, in particular a straight longitudinal axis, so that the center electrode and the outer conductor are arranged coaxially to one another. With such an arrangement, the electrode branches can branch into several directions extending away from the outer conductor as well as away from the center electrode. This is favorable for the formation of far-reaching corona discharges.

For the voltage required for producing high-frequency corona discharges to remain as small as possible the electrode branches should be pointed and end in tips. At the same time, the tips of the electrode branches should not become too hot either. For cooling the electrode branches, their cross section should advantageously increase from the tip of the electrode branches in direction of the longitudinal median line of the ignition electrode.

The ignition electrode preferably has a section extending coaxially to the outer conductor. This section is designated below as the center electrode and has a front end, on which an electrically conducting head section, produced separately, is mounted, from which the electrode branches originate. This provides a number of additional advantages:

- As the electrode branches come out of a head section which is formed separately from the center electrode, the igniter can—with the same basic construction, comprising an insulator and therein embedded a center electrode, an outer conductor and a housing, which can also function as the outer conductor—be fitted selectively with different head sections, which are suitable for different engines and different installation conditions.

The head section can be connected to the end of the center electrode in different ways:

The center electrode can have an outer thread at its front end, which can be screwed into an inner thread provided in the head section.

Another possibility is providing a hole in the centre of the head section, into which the front end of the ignition electrode is pressed.

Another possibility is providing a sleeve in the centre of the head section, in which the front end of the center electrode is inserted and attached by crimping.

Another possibility is in welding the head section to the front end of the center electrode, in particular by laser welding. In this context it is advantageous if the front end of the center electrode is blunt.

Another advantageous possibility is forming the head section out of sheet metal, in which a number of electrode branches is punched out. This sheet metal is provided with a hole in its centre and a shoulder is formed at the end of the center electrode, which separates two sections of the center electrode of various diameter from one another. The section with the smaller diameter forms the front end of the center electrode. This front section of the center electrode is inserted through the hole in the head section and riveted thereto on the side of the head section facing away from the shoulder, for which purpose the front and thinner section of the center electrode serves as a rivet shank, whose portion protruding over the head section is transformed into a rivet head.

An ignition electrode with a head section produced separately can be manufactured easily, with accuracy and cost-efficiently.

Long electrode branches can be produced simply with a head section produced separately, however at most up to the core diameter of an outer thread of the igniter, with which said igniter is screwed into a threaded bore of a combustion engine. The inner diameter of the threaded bore respectively the core diameter of the outer thread of the igniter limit the distance which may separate the electrode branches from the longitudinal axis of the outer conductor of the igniter. The outer thread of the igniter is advantageously provided also on the outer conductor of the igniter.

The greater the distance of the ends of the electrode branches from the longitudinal axis of the outer conductor, which preferably comprises the outer thread as well, the greater the distance of the ends of the electrode branches from one other. The distance of the ends of the electrode branches from one another should be as large as possible, because high-frequency corona discharges can weaken each other, when they come out of electrode branches, whose ends are too close to one another. It is therefore preferable that the distance of the ends of the electrode branches from the longitudinal axis of the outer conductor is only slightly smaller than half the core diameter of an outer thread provided on the outer conductor. With such a sizing, the number of the electrode branches which can come out of the head section is particularly large without corona discharges arising from the branches weakening each other.

But it is also possible to arrange the electrode branches so that they end with various distances from the longitudinal axis of the outer conductor, for instance in such a way that a first group of electrode branches ends with a larger distance from the longitudinal axis of the outer conductor and another group of electrode branches ends with a smaller distance from the longitudinal axis of the outer conductor. The electrode branches of the first group then end preferably in a first plane and the electrode branches of the other group end preferably in another plane, which is preferably parallel to the first plane. Additional space can be gained by distributing the ends of the electrode branches over two planes, so as to accommodate even more electrode branches, without their the corona discharges coming out of them weakening each other.

There is preferably a direct connection between the head section and the insulator, so that heat can be dissipated via the center electrode and via the insulator and via the outer conductor connected therewith. The electrode branches can be completely embedded into the insulator. The tips of the electrode branches are preferably situated close below the surface of the insulator or end in the surface of the insulator. The tips of the electrode branches are thus protected without losing on functionality. Heat dissipation via the outer conductor is particularly efficient, because the combustion engine is usually cooled, in particular water cooled, so that good heat dissipation is ensured from the outer conductor and indirectly also from the electrode branches.

For good heat dissipation it is advantageous if the electrode branches are connected to the head section as a single piece. This enables at the same time straightforward production of the head section especially when—as preferred—the head section is formed out of a sheet metal. In such a case, the head section together with the electrode branches coming out of them can be cut out of a sheet metal in a single production step and then transformed, in particular via a combined punching and bending process. The punch cuts are advantageously positioned in such a way that the electrode branches taper. In complement thereto, the sheet metal can be dressed to size for instance by means of a rotating ring-shaped abrasive wheel before the punching process or after the punching process in the region of the electrode branches, which reduces the thickness of the electrode branches in such a way that the thickness decreases progressively towards the tips of the electrode branches. The bending process enables to bend the electrode branches into any desired direction extending away from the outer conductor and away from the center electrode, provided that a discharge taking place directly between the electrode branches and the outer conductor of the igniter can be avoided.

In an advantageous refinement of the invention, the ends of the electrode branches lie in a common plane on a circle and the electrode branches point to directions, which are tilted by the same angle with respect to an axis, which is perpendicular on the common plane and runs through the centre of the circle. This is favorable in particular in combination with a cylindrical combustion chamber, for obtaining corona discharges, which extend in a large volume of space. The longitudinal axis of the outer conductor can pass through the centre of the circle, on which the electrode branches end. Thus an appropriate arrangement of the electrode branches for the propagation of the corona discharges can then be obtained under the given boundary condition that the distance of the ends of the electrode branches from the longitudinal axis of the outer conductor is smaller than the core diameter of the outer thread of the igniter. If in a cylindrical combustion chamber the threaded bore is arranged coaxially to the cylinder axis of the combustion chamber for accommodating the igniter, the centre of the circle on which the electrode branches end, can lie on the cylinder axis of the combustion chamber.

Such can still be the case and is preferably also the case when the threaded bore for accommodating the igniter does not run coaxially or parallel to the cylinder axis, but rather encloses an angle with the cylinder axis. In such a case, the electrode branches ending on the circle have different lengths. Even in such a case the electrode branches can be an integral part of a head section, which is formed out of a sheet metal by a combined punching and bending process. Indeed in such a case, the head section can not be designed symmetrically any longer as regards the outer thread of the igniter, which is preferably situated on the outer conductor.

In another advantageous embodiment of the igniter according to the invention, the ends of a first group of two to four electrode branches lie in a first plane and the ends of at least one other group of electrode branches respectively lie in another plane, which runs parallel to the first plane. The ends of the electrode branches of the first group lie on a first circle and the ends of the electrode branches of the at least one other group lie on another circle. The circles are arranged coaxially to one another and may have identical or different radii. When looking in the direction of the axis running through the centres of the circles, every electrode branch of every single group lies between any two electrode branches of another group. Preferably, exactly two such groups of electrode branches are present. Such an arrangement is useful not only for igniters, which are screwed in coaxially to the cylinder axis of a cylindrical combustion chamber in its cylinder head, but also for applications, in which the igniter cannot be arranged coaxially to the cylinder axis of the combustion chamber, but rather offset laterally and obliquely to the cylinder axis. Even a head section with electrode branches, which are arranged in this manner, can be manufactured by a combined punching and bending process.

Under the boundary condition that the threaded bore, in which the igniter must be screwed in, has a thread ranging from M10 to at most M14, it is preferred that ends of two, three or at most four electrode branches lie in a common plane and therein preferably on a common circle.

Instead of ending on a circle, the ends of a group of electrode branches can also end on corners of a flat polygon. The circle or the polygon are not present physically, but rather only defined by the position of the ends of the electrode branches.

Preferably, five to nine, in particular five to seven electrode branches come out of the head section. The solid angle between the directions to which the ends of the electrode branches point, ranges preferably between 15° and 60° and is preferably greater than 30°. The distance of neighboring ends of the electrode branches ranges more appropriately from 2 mm to 7 mm and is preferably greater than 3 mm.

The accompanying schematic drawings below provide better explanation of the invention. Identical and correlating parts are designated with matching reference numbers in the different examples of embodiment.

Figure 1:
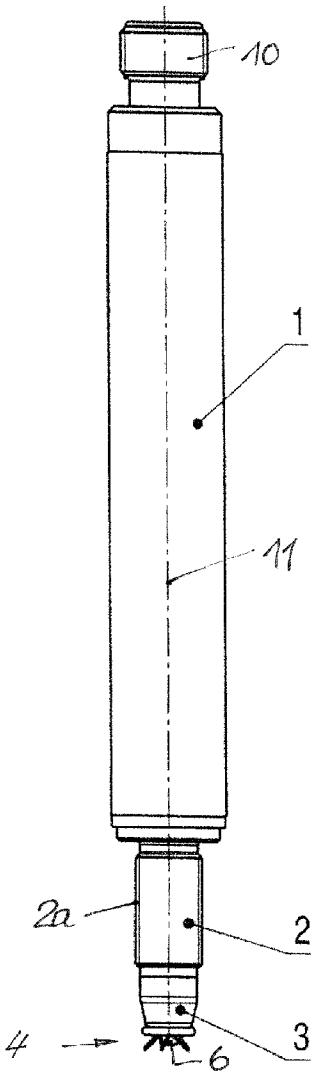

FIG. 1 shows an igniter according to the invention in a side view.

Figure 2:
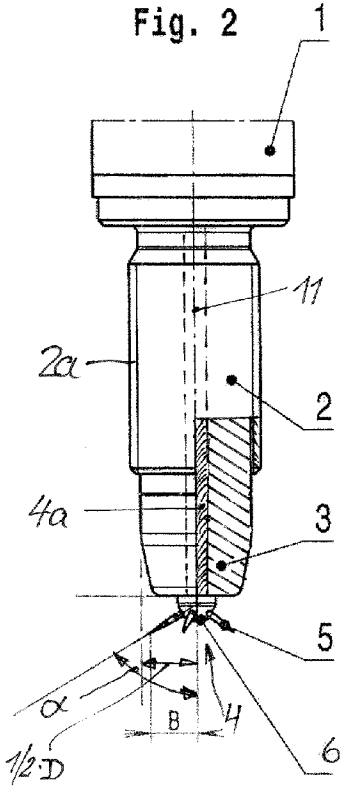
Figures 4, 5, 6:
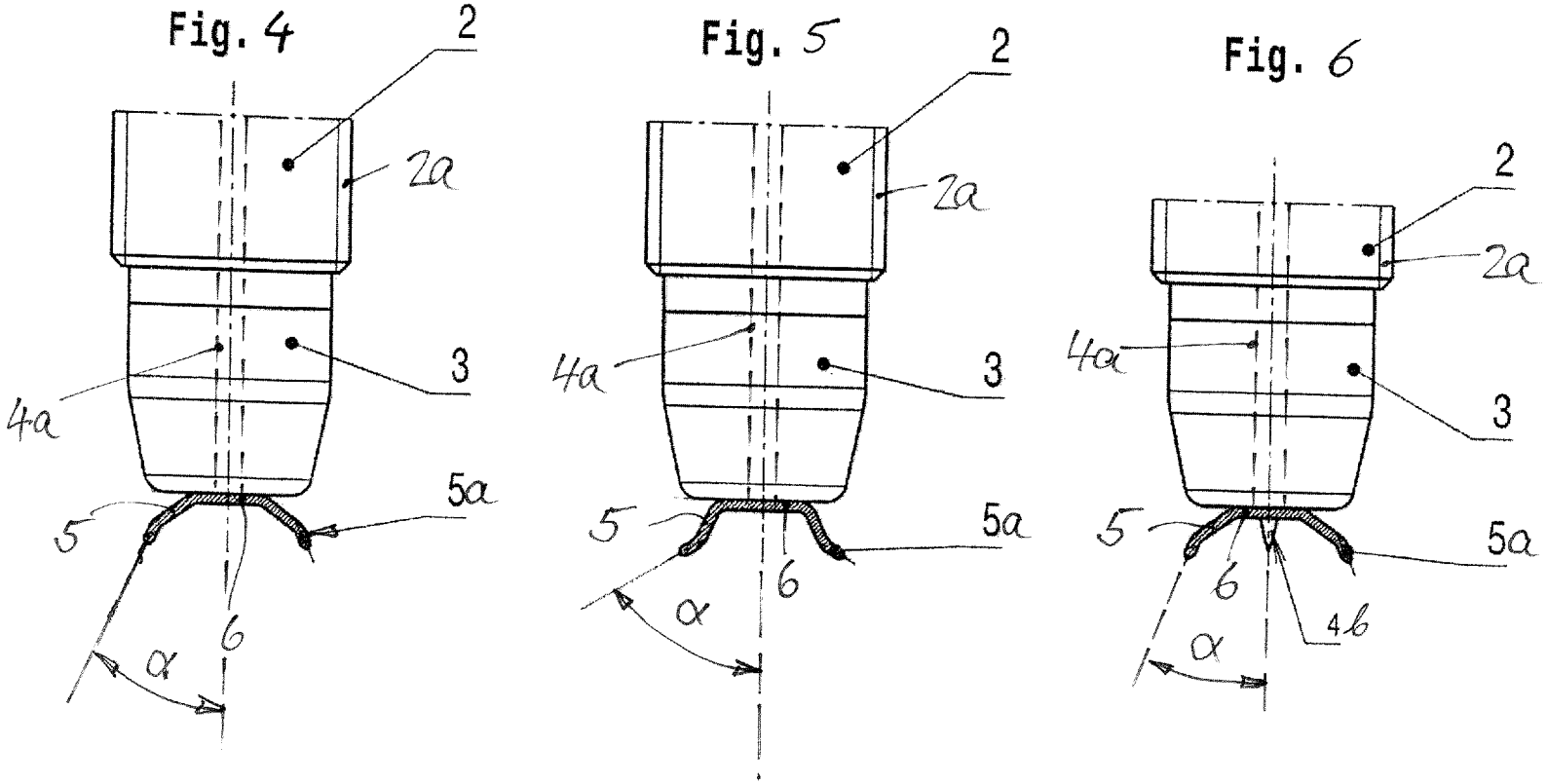
Figure 7:
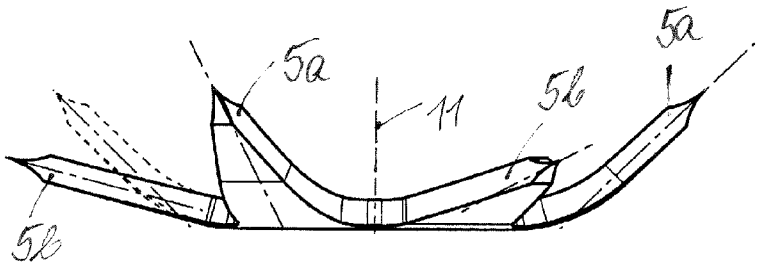
Figure 8:
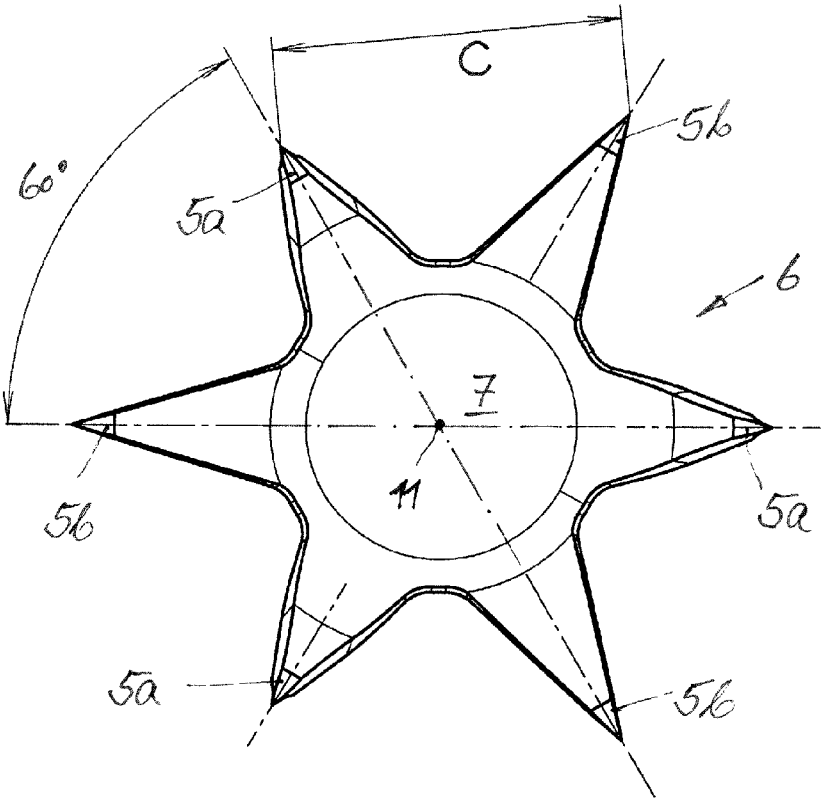
Figure 9:
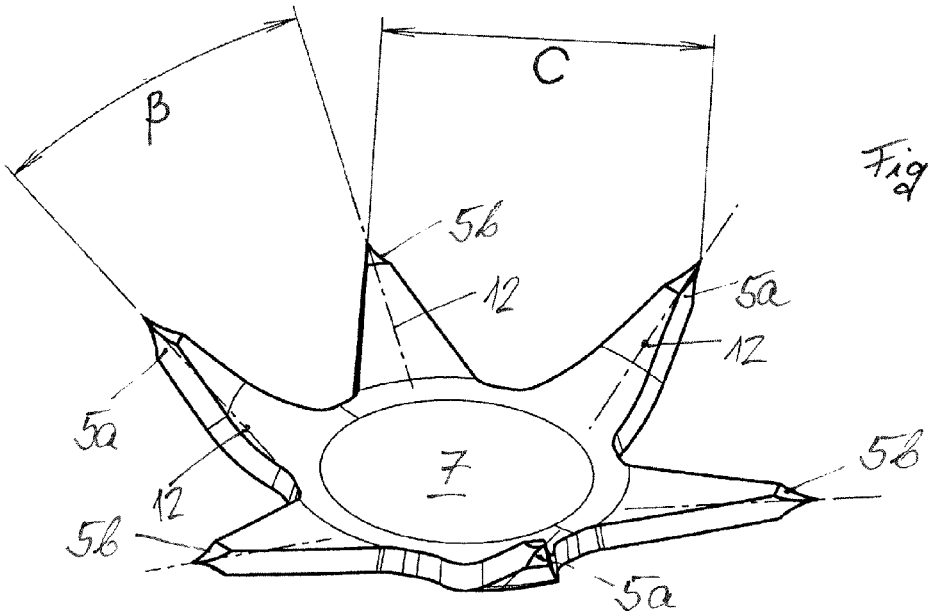
Figure 10:
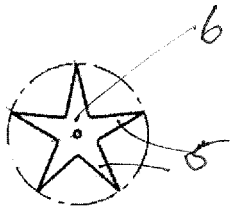
Figure 11:
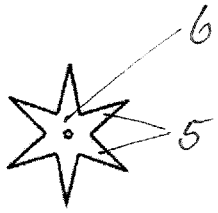
Figure 12:
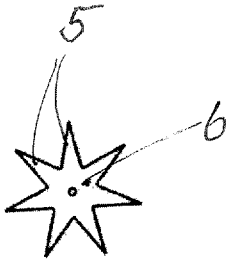
Figure 13:
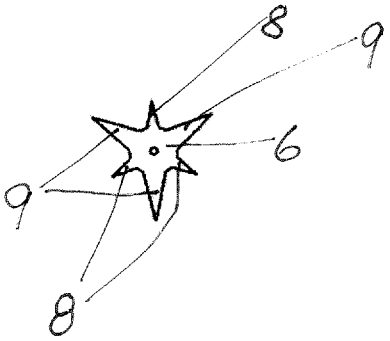
Figure 14:
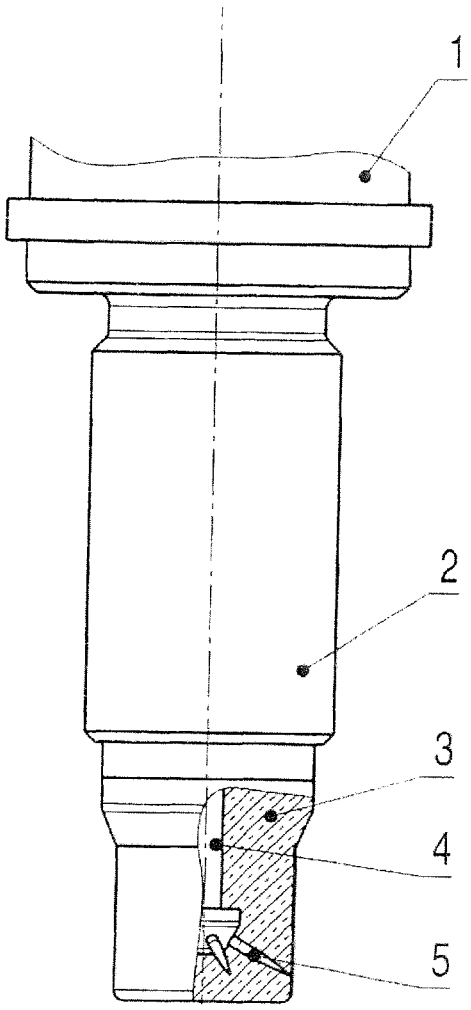
Figure 15:
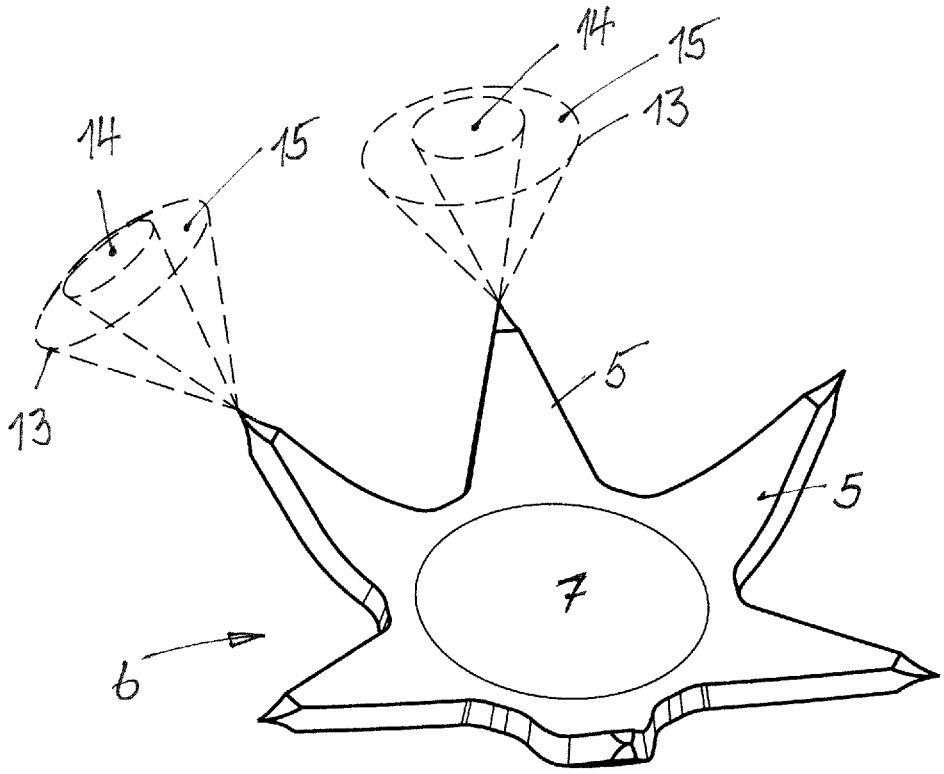

FIG. 2 shows in detail the front section of the igniter of FIG. 1 in an enlarged side view, FIG. 3 shows the front section of an igniter in a side view as in FIG. 2 with electrode branches formed differently, FIGS. 4 and 5 show the front section of igniters as in FIG. 3, however with modified form of the electrode branches, FIG. 6 shows an igniter as in FIG. 4, however complemented by a central electrode tip, FIG. 7 shows a vastly enlarged view of a preferred embodiment of a head section of an igniter according to the invention in a side view, FIG. 8 shows the head section of FIG. 7 in an elevation view, FIG. 9 shows the head section of FIG. 7 in an oblique view, FIG. 10 shows the head section of the igniter of FIG. 3 in an elevation view, the FIGS. 11 to 13 show elevation views of modified head sections, FIG. 14 shows an further embodiment of an igniter according to the invention, and FIG. 15 shows in an oblique view a head section of an igniter according to the invention in a representation similar to FIG. 9 with a diagrammatical illustration of the propagation of charge clouds during the occurrence of a high-frequency corona discharge.

FIG. 1 shows an igniter according to the invention. The igniter comprises in coaxial arrangement a substantially cylindrical, metallic housing 1, a subsequent metallic outer conductor 2 and an insulator 3, which preferably consists of ceramic, in particular of aluminum oxide. The insulator 3 encloses an ignition electrode 4, from which a head section 6 protrudes from the insulator 3. The head section 6 and a rod-shaped center electrode 4*a* together are the ignition electrode 4. The center electrode 4*a* is embedded into the insulator 3 and extends through the outer conductor 2 up into the housing 1. The insulator 3 is arranged in the outer conductor 2 and encloses the center electrode 4*a* in coaxial arrangement. A metric outer thread 2*a*, with which the igniter can be screwed into a threaded bore of a combustion engine provided to that end, is provided on the outer conductor 2.

The housing 1 usually contains elements of a high-frequency resonant circuit which feeds the ignition electrode 4. An electrical connection piece 10 intended for the current supply of the igniter is situated on the rear end of the housing 1.

The head section 6 of the ignition electrode 4 branches into several electrode branches 5, which are oriented outwardly in a star pattern from the longitudinal axis 11 of the igniter obliquely to the longitudinal axis 11, and more precisely away from the insulator 3 and away from the outer conductor 2.

FIG. 2 shows in enlarged scale the front end of the igniter of FIG. 1 in a side view and partially in profile. It can be seen that the center electrode 4*a* ends bluntly against a ball-shaped head section 6, which is welded to the front end of the center electrode 4*a*. The head section 6 consists preferably of the same metal as the center electrode 4*a*, for instance of a non-corrosive steel. Five electrode branches 5 come out of the head section 6 and all of them have the same length, are arranged rotationally symmetric with respect to the longitudinal axis 11 around said axis and all of them are tilted by the same angle $\alpha$ against the longitudinal axis 11. The angle $\alpha$, by which the electrode branches 5 are tilted against the longitudinal axis 11, is in the example of FIG. 2 equal to $\alpha=60°$. The electrode branches 5 end at a distance B from the longitudinal axis 11, which is slightly smaller than half the core diameter D of the thread 2*a*.

The exemplary embodiment illustrated in FIG. 3 differs from the embodiment illustrated in FIG. 2 in that the head section 6 is formed out of a sheet metal by a punching and bending process, which is welded or riveted to the front end of the center electrode 4*a*. The head section 6 has five electrode branches 5, which are designed rectilinear, extend symmetrically around the longitudinal axis 11 with the same angular distances and are tilted by an angle $\alpha=45°$ against the longitudinal axis 11. The electrode branches 5 end at a distance B from the longitudinal axis 11, which is slightly smaller than half the core diameter D of the outer thread 2*a*.

The embodiment illustrated in FIG. 4 differs from the embodiment illustrated in FIG. 3 in that the electrode branches 5 are bent off twice. The ends 5*a* are thus oriented in such a way that they enclose a different angle, e.g. an angle $\alpha=25°$ with the longitudinal axis 11.

In the embodiment illustrated in FIG. 5, the electrode branches 5 are also bent off twice. In contrast to FIG. 4, where they have been bent twice in direction of the longitudinal axis 11, they are in FIG. 5 bent once towards the longitudinal axis 11 and a second time away from the longitudinal axis 11. The ends 5*a* of the electrode branches 5 are thus oriented in such a way that they enclose an angle $\alpha=60°$ with the longitudinal axis 11 of the igniter.

In the embodiment illustrated in FIG. 6, the electrode branches 5 are also formed as in the embodiment of FIG. 4, they are however complemented by a central electrode tip 4*b*, which extends in direction of the longitudinal axis 11.

The electrode branches 5 end at a distance B from the longitudinal axis 11, also in the examples of FIGS. 4, 5 and 6. The distance B is slightly smaller than half the core diameter D of the outer thread 2*a*.

FIGS. 7 to 9 show in detail an embodiment of a particularly suitable head section 6 for the ignition electrode 4. It is formed out of a sheet metal by a combined punching and bending process. It has a flat, circular central section 7, from which two groups of electrode branches are bent off. The tapering ends 5*a* of the first group lie on a first circular arc and the tapering ends 5*b* of the second group lie on a second circular arc. Both arcs are arranged coaxially, their centers lie on the longitudinal axis 11 of the igniter. The planes, in which both circles lie, are spaced apart from one another. In the elevation view (FIG. 8), the electrode branches 5 appear under a mutual angle of 60°. The solid angle β between the longitudinal median lines of neighboring electrode tips 5*a* and 5*b* is advantageously between $\beta=15°$ and $\beta=60°$, preferably greater than 30°. The distance C of neighboring electrode tips 5*a* and 5*b* should lie between 2 mm and 7 mm, preferably greater be than 3 mm. This can guarantee that on the one hand a large volume of space is occupied by the corona discharges and that on the other hand the individual corona discharge do not influence and weaken each other.

The head section 6 shown in FIGS. 7 to 9 can be bluntly welded to the end of a center electrode 4*a*. If a hole is provided in the centre 7 of the head section 6, the head section 6 can also be riveted to the end of the center electrode 4*a*, if a shoulder or similar stop is formed on the center electrode 4*a*, on which shoulder the head section 6 can be arranged.

FIGS. 10 to 13 show various head sections 6 in an elevation view, namely in FIG. 10 with five electrode branches 5 arranged symmetrically, in FIG. 11 with six electrode branches 5 arranged symmetrically, in FIG. 12 with seven electrode branches 5 arranged symmetrically and in FIG. 13 with two groups 8 and 9 of each three electrode branches 5, which may have different lengths and can be bent off in a different manner. The electrode branches 5 in the embodiments of the FIGS. 10 to 12 are bent off in such a way that their ends lie on a circle respectively.

The form and the orientation of the electrode branches 5 may adapt the corona discharges quite simply and optimally to the geometries of the combustion chamber. Assemblies of three to nine electrode branches 5 in a star pattern have proved themselves, in particular of five to seven electrode branches 5, which are each oriented away from the outer conductor 2 and away from the insulator 3 into the combustion chamber, in particular in the direction of the piston crown of a piston traveling in the combustion chamber.

To obtain a sufficient distance between the ends 5*a* and 5*b* of the electrode branches 5, the ends 5*a*, 5*b* can be arranged not only on a circle, but can also be arranged with different distances from the longitudinal axis 11 and/or with a different distance from the front end of the insulator 3. These different positionings may be obtained inasmuch as on the one hand the length of the electrode branches 5 differs and on the one hand the bending of the electrode branches 5 differs.

The head section 6 can be produced quite simply out of a sheet metal by punching and bending. The punching process can be replaced with a cutting process or an electrical discharge machining. The angle β between the directions, to which the ends 5*a*, 5*b* of neighboring electrode branches point, should be selected in such a way that the corona discharges coming out of the ends 5*a* and 5*b* influence and disturb each other as little as possible. The three-dimensional distance C of neighboring ends 5*a*, 5*b* of the electrode branches 5 should lie in the range of C=2 mm to C=7 mm and preferably amount to more than 3 mm.

The direction, to which the tapering ends 5*a* and 5*b* of the electrode branches 5 are oriented, define the outlet directions of the corona discharges. An advantageous propagation of the corona discharges is achieved when the solid angle β between neighboring tapering ends 5*a* and 5*b* of the electrode branches 5 lies between $\beta=15°$ and $\beta=60°$ and is preferably larger than 30°. This is quite suitable for the corona discharges to occupy a large volume of space and not to disturb each other.

According to the given installation conditions, there can be an optimal orientation for the head section 6 of the ignition electrode 4. A stop surface on the center electrode 4*a*, on which the head section 6 is attached, can simplify the positioning of the head section 6.

Depending on the installation situation in the combustion chamber it may prove advantageous not to provide any rotationally symmetric propagation of the corona discharges. For this purpose, a corresponding asymmetrical head section 6 can be attached on the center electrode 4*a*. The orientation of the head section 6 can be facilitated by a mechanical angular coding between the center electrode 4*a* and the head section 6.

FIG. 14 shows an further embodiment of an igniter, in which the head section 6 and the electrode branches 5 are embedded in the insulator 3. In this manner, the electrode branches 5 are protected against damages when the igniter is being installed in an engine.

The electrode branches 5 can be embedded into the insulator 3 by injection molding. They are embedded into the insulator 3 over their whole length. A cover with a thin film of insulating material, which for instance can be up to 10 μm thick, on the pointed ends 5*a*, 5*b* of the electrode branches 5 is not an obstacle to the ignition of a high-frequency corona discharge. But the free ends 5*a*, 5*b* of the electrode branches 5 may also protrude from the insulator 3 by a fraction or end exactly in the surface of the insulator 3. To do so, the pointed ends 5*a*, 5*b* of the electrode branches 5 can be covered by the insulating material.

FIG. 15 shows that the progression of the corona discharge from the tips of the electrode branches 5 of a head section 6 can be imagined idealized in such a way that the charge carrier clouds 13 propagate in a conical manner, with a core region 14 of high charge carrier density and with an edge region 15 of a lower charge carrier density in contrast thereto.

LIST OF REFERENCE NUMBERS

1. Housing
2. Outer conductor

2*a*. Outer thread
3. Insulator
4. Ignition electrode
4*a*. Center electrode
4*b*. Central electrode tip
5. Electrode branches
5*a*. Ends of 5
5*b*. Ends of 5
6. Head section
7. Central section of 6
8. First group of electrode branches
9. Second group of electrode branches
10. Electrical connection piece
11. Longitudinal axis
12. Longitudinal median line
13. Charge clouds
14. Core region of 13
15. Edge region of 13
α Angle, by which the electrode branches 5 are tilted against the longitudinal axis 11.
β Solid angle between the longitudinal median lines of neighboring electrode tips
B Distance of ends 5*a*, 5*b* of electrode branches from the longitudinal axis 11
C Distance of neighboring electrode tips 5*a*, 5*b* from one other
D Core diameter of the thread 2*a*

The invention claimed is:

1. An igniter for igniting a fuel-air-mixture in a combustion chamber, in particular in a combustion engine with one or several combustion chambers, by generating a high frequency corona discharge, said ignitiger comprising an assembly comprising an ignition electrode, an outer conductor surrounding the ignition electrode, which has a front end and a rear end, and an electrical insulator arranged between the ignition electrode and the outer conductor, wherein the ignition electrode is part of an electrical high-frequency resonant circuit, protrudes over the front end of the outer conductor, and is connected to an alternate current source or alternate voltage source which feeds the HF-resonant circuit and delivers a high frequency alternate current or a high frequency alternate voltage, respectively, wherein the ignition electrode is branched into more than four electrode branches extending away from the outer conductor, in different directions such that any two electrode branches are farthest apart from one another at their pointed ends and the solid angles between the directions to which any two neighboring electrode branches point with their pointed ends are so large that charge carrier clouds caused by HF-corona discharges and coming out of the electrode branches overlap at most in their edge regions.

2. An igniter according to claim 1, wherein the ends of the electrode branches are arranged in regular angular distances around the longitudinal axis of the center electrode.

3. An igniter according to claim 1, wherein the cross section of the electrode branches increases from their pointed ends towards the longitudinal median line of the ignition electrode.

4. An igniter according to claim 1, wherein the solid angle β between the directions, to which the ends of the electrode branches point, ranges between β=15° and β=60° and is preferably greater than 30°.

5. An igniter according to claim 1, wherein five to nine, in particular five to seven electrode branches come out of the head section.

6. An igniter according to claim 1, wherein the distance of the neighboring ends of the electrode branches is 2 mm to 7 mm and is preferably greater than 3 mm.

7. An igniter according to claim 1, wherein the distance of the ends of the electrode branches from the longitudinal axis of the outer conductor is smaller, preferably only slightly smaller than half the core diameter of an outer thread provided on the outer conductor.

8. An igniter according to claim 1, wherein the ignition electrode comprises a center electrode running coaxially to the outer conductor and an electrically conducting head section that is a separate part which is mounted on a front end of the center electrode, wherein the electrode branches come out of said head section.

9. An igniter according to claim 8, wherein the head section is a disc or has the form of a disc.

10. An igniter according to claim 8, wherein the electrode branches are connected to the head section as a single piece.

11. An igniter according to claim 8, wherein the head section is welded to the center electrode, preferably to a blunt end of the center electrode.

12. An igniter according to claim 8, wherein the head section is riveted to the center electrode.

13. An igniter according to any one of the claim 8, wherein the head section is cut out of a sheet metal and bent together with the electrode branches as a single piece.

14. An igniter according to claim 13, wherein the thickness and preferably also the width of the electrode branches increases starting from the ends of the electrode branches in direction of the centre of the disc.

15. An igniter according to claim 1, wherein the ends of the electrode branches lie on a circle in a common plane and point into directions, which are tilted with the same angle with respect to an axis which is vertical on the common plane and runs through the centre of the circle.

16. An igniter according to claim 1, wherein the ends of a first group of two to four electrode branches lie in a first plane and the ends of at least one another group of electrode branches lie in another plane, which runs parallel to the first plane, and in that the ends of the first group of the electrode branches lie on a first circle and the ends of the electrode branches of the at least one another group lie on another circle, and in that the circles are arranged coaxially to one another and that when looking into the direction of the axis running through the centre of the circle, each electrode branch of every single group lies between any two electrode branches of the other groups.

17. An igniter according to claim 16, wherein exactly two groups of electrode branches are present.

18. An igniter according to claim 12, wherein the ends two, three or four electrode branches lie in a common plane.

19. An igniter according to claim 15, wherein the longitudinal axis of the outer conductor goes through the centre(s) of the circle(s).

20. An igniter according to claim 1, wherein the electrode branches are embedded in an insulating material.

21. An igniter according to claim 20, wherein the electrode branches are completely embedded in the insulating material and end on the surface or tightly below the surface of the insulator.

22. An engine, in particular an engine for a vehicle, with one or several combustion chambers, which each have an igniter having the features according to one of the previous claims.

* * * * *